US006269515B1

(12) United States Patent
Varma

(10) Patent No.: US 6,269,515 B1
(45) Date of Patent: Aug. 7, 2001

(54) APPARATUS FOR CLEANING AN OPTICAL FIBER SPLICER ELECTRODE

(75) Inventor: Ramesh Varma, Berkeley Heights, NJ (US)

(73) Assignee: TyCom (US) Inc., Morristown, NJ (US)

( * ) Notice: Subject to any disclaimer, the term of this patent is extended or adjusted under 35 U.S.C. 154(b) by 0 days.

(21) Appl. No.: 09/276,797

(22) Filed: Mar. 26, 1999

(51) Int. Cl.[7] ..... A46B 3/00; A46B 15/00

(52) U.S. Cl. ..... 15/160; 15/169; 15/184; 15/191.1; 15/200; 15/207.2; 15/143.1

(58) Field of Search ..... 15/104.2, 160, 15/168, 169, 184, 191.1, 200, 206, 207.2, 192, 193, 143.1

(56) References Cited

U.S. PATENT DOCUMENTS

| | | | | |
|---|---|---|---|---|
| 306,455 | * | 10/1884 | Abraham | 15/104.2 |
| 541,537 | * | 6/1895 | Hankey | 15/200 |
| 783,937 | * | 2/1905 | Edwards et al. | 15/184 X |
| 2,391,077 | * | 12/1945 | Sticht | 15/193 X |
| 2,485,822 | * | 10/1949 | Goldrich | 15/169 X |
| 2,682,069 | * | 6/1954 | Scriminger | 15/104.2 X |
| 3,106,738 | * | 10/1963 | Bohne | 15/184 |
| 3,193,863 | * | 7/1965 | Myers et al. | 15/169 |
| 4,129,918 | * | 12/1978 | Lee | 15/169 |
| 4,133,070 | * | 1/1979 | Litt | 16/206 X |
| 4,561,214 | * | 12/1985 | Inoue | 15/104.14 X |
| 4,734,953 | * | 4/1988 | Dodson | 15/184 X |
| 5,305,490 | * | 4/1994 | Lundgren | 15/143.1 X |
| 5,333,343 | * | 8/1994 | Nichols et al. | 15/184 X |

FOREIGN PATENT DOCUMENTS

| | | | | |
|---|---|---|---|---|
| 585589 | * | 3/1977 | (CH) | 15/169 |

* cited by examiner

*Primary Examiner*—Mark Spisich

(57) ABSTRACT

An apparatus and method for cleaning electrodes of an optical fiber splicing apparatus is disclosed. In one embodiment of the present invention, the cleaning apparatus includes a plurality of tungsten wires and a support member. The plurality of tungsten wires are coupled to the support member at a first end of the support member. The cleaning apparatus may also include a cover that is slidably disposed on the support member. The cover is slidable between a first position where the cover is disposed away from the plurality of tungsten wires and a second position where the plurality of tungsten wires are received within the cover.

11 Claims, 4 Drawing Sheets

APPARATUS FOR CLEANING AN OPTICAL FIBER SPLICER ELECTRODE

BACKGROUND OF THE INVENTION

The present invention relates to an apparatus and method for cleaning an optical fiber splicing apparatus. More specifically, the invention provides for cleaning the electrodes of an optical fiber splicer with a tungsten wire brush.

In order to join two optical fibers together such that optical signals may be transferred from one optical fiber to the other optical fiber, the fibers may be spliced together by utilizing a splicing apparatus. Optical fiber splicers are well-known in the art and may utilize tungsten electrodes. As can be seen in FIG. 1, an end of optical fiber 100 is positioned in proximity to an end of optical fiber 200 between the electrodes 300 and 350 of the splicing machine (not illustrated). An arc is applied across the gap between tungsten electrodes 300 and 350 to fuse the ends of fibers 100 and 200 together. Thus, fibers 100 and 200 are joined together such that optical signals may be transferred from one of the optical fibers to the other of the optical fibers.

When an arc is applied across tungsten electrodes 300 and 350 to fuse optical fibers 100 and 200 together, residue, such as silicon particles 400, is deposited onto the electrodes. A build-up of these particles on the electrodes will result in a decreased ability of the electrodes to splice two optical fibers together. Therefore, it is desirable to remove as large a portion of the residue from the electrodes as possible. Currently, a tool is available for removing some of the residue from the electrodes, however, problems exist with the currently known tool.

The currently known tool is a brush-type apparatus where the brush includes glass bristles. The operator brushes the glass bristles across the tungsten electrodes attempting to remove the residue from the electrodes. Since the glass bristles are not as hard a material as are the tungsten electrodes, the bristles are not able to effectively remove a large majority of the residue from the electrodes. Typically, the glass bristles are only able to remove approximately 50% of the residue from the surface of the electrodes. The bristles do not remove those silicon particles that are more deeply embedded in the tungsten electrodes.

Therefore, it would be desirable to provide an improved apparatus and method for cleaning residue from the electrodes of an optical fiber splicing machine.

SUMMARY OF THE INVENTION

In accordance with the present invention, an apparatus and method for cleaning electrodes of an optical fiber splicing apparatus is provided. In one embodiment of the present invention, the cleaning apparatus includes a plurality of tungsten wires and a support member. The plurality of tungsten wires are attached to the support member at a first end of the support member. The cleaning apparatus may also include a cover that is slidably disposed on the support member. The cover is slidable between a first position where the cover is disposed away from the plurality of tungsten wires and a second position where the plurality of tungsten wires are received within the cover.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
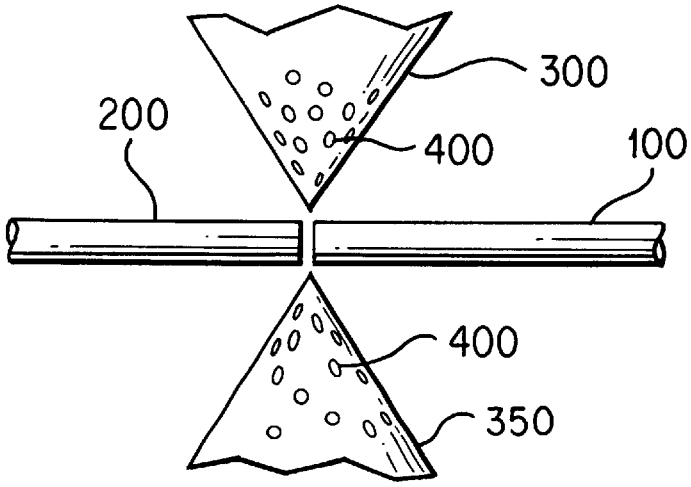
FIG. 1 illustrates the electrodes of an optical fiber splicer and the silicon particles that are deposited on the electrodes as a result of splicing together two optical fibers.
Figure 2:
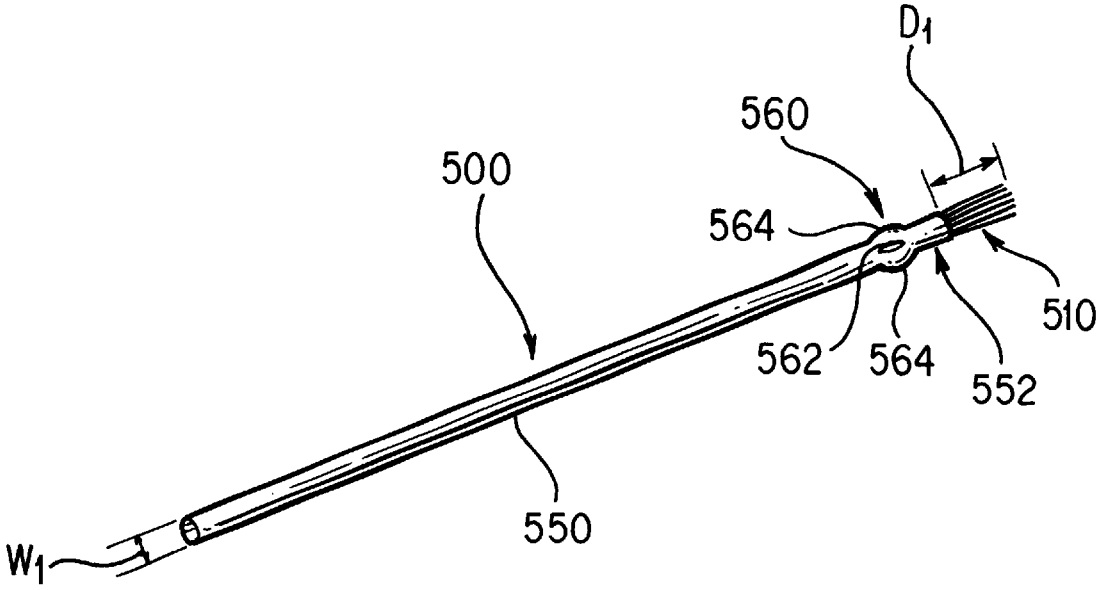
FIG. 2 illustrates an electrode cleaning apparatus in accordance with a first embodiment of the present invention.

FIG. 2 illustrates a first embodiment for an electrode cleaning tool in accordance with the principles of the present invention. Electrode cleaning tool 500 includes a plurality of tungsten wires 510 and a support member 550. The plurality of tungsten wires 510 are attached to a first end 552 of support member 550 and extend from support member 550 along the longitudinal axis of support member 550.

In this embodiment, support member 550 may be a thin, hollow, elongated structure that can be manufactured from either a plastic or metal material. The only consideration for structurally forming support member 550 is that it should remain rigid when a user is gripping support member 550 in his/her hands and cleaning the electrodes of the optical fiber splicing machine with the plurality of tungsten wires 510, as will be further explained later in this specification. Support member 550 has an outer diameter $W_1$. In one embodiment, this outer diameter is approximately one-eighth of an inch.

Included at first end 552 of support member 550 is a stop 560, or a crimped portion. Stop 560 may be formed by crimping the material which comprises support member 550 such that a plurality of indentations 562 and a plurality of extended portions 564 are formed on support member 550. In FIG. 2, one indentation 562 is visible and two extended portions 564 are visible, however, as can be understood, additional indentations 562 and extended portions 564 may exist on support member 550. In one embodiment for support member 550 there are four indentations 562 and four extended portions 564 on support member 550 with each of the extended portions and indentations equally spaced around the outer circumference of support member 550.

Figure 4:
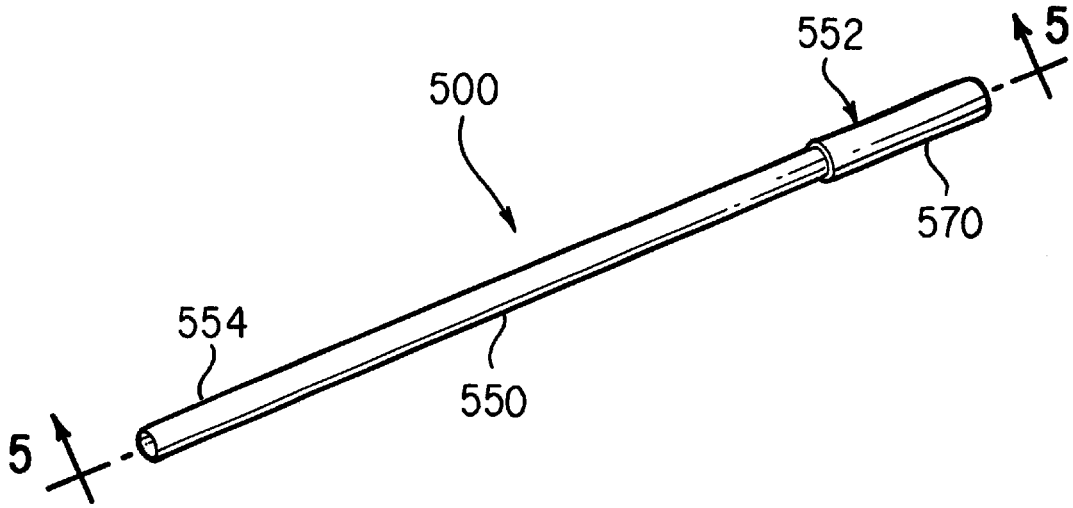
FIG. 4 illustrates the electrode cleaning apparatus and cover of FIG. 3 with the cover disposed in a second position on the cleaning apparatus.
Figure 5:
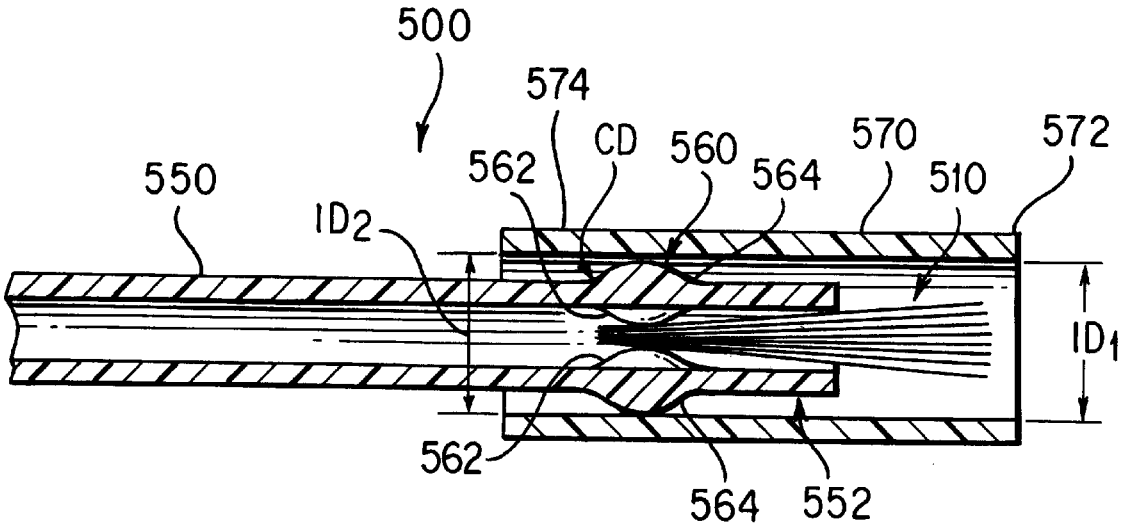
FIG. 5 is a cross-sectional view of the cleaning apparatus and cover as taken along line 5—5 of FIG. 4.

As can be seen in FIG. 2, extended portions 564 extend a distance beyond the outer diameter of the elongated portion of support member 550. The distance that extended portions 564 extend beyond the outer diameter of support member 550 is not rigidly defined, however, the purpose of extended portions 564 is to serve as a stop for a cover that may be included with electrode cleaning tool 500 and which will be further explained in connection with FIGS. 3 and 4. As can be understood, indentation 562 is formed as a depression within support member 550. Thus, the material of support member 550 that is compressed to form indentation 562 extends within the inner diameter of support member 550, which can be seen in FIG. 5 (two indentations 562 are illustrated in FIG. 5). The internal extension of the material of support member 550 which forms indentation 562 on the outer surface of support member 550 may be utilized to secure the plurality of tungsten wires 510 within support member 550. The plurality of tungsten wires 510 are inserted into first end 552 of support member 550 such that they extend within support member 550 at least to a position where they extend beyond the location on support member 550 where stop 560 will be formed. After the plurality of tungsten wires 510 are positioned within first end 552 of support member 550, stop 560, which defines indentations 562 and extended portions 564, can be formed on support member 550 such that the plurality of tungsten wires 510 can be secured within support member 550. Thus, stop 560 may serve the dual purposes of providing a structure for engaging a cover that may be included on support member 550 and securing the plurality of tungsten wires 510 within support member 550.

As stated previously, the plurality of tungsten wires 510 are attached to a first end 552 of support member 550 and extend from first end 552 along the longitudinal axis of support member 550. The quantity of tungsten wires 510 that are included in electrode cleaning tool 500 is not rigidly defined. A representative number for the quantity of wires in electrode cleaning tool 500 is 100–200 wires. Tungsten wires 510 extend a distance $D_1$ from first end 552 of support member 550. In one embodiment that distance is approximately 0.50 inches. Additionally, in an embodiment, the tungsten wires have a diameter of 0.0030 inches. However, the diameter of the wires may be, for example, between 0.0020 and 0.0040 inches. It could be possible that a larger diameter wire could damage the electrodes and a smaller diameter wire could not be as effective in cleaning the electrodes.

Figure 3:
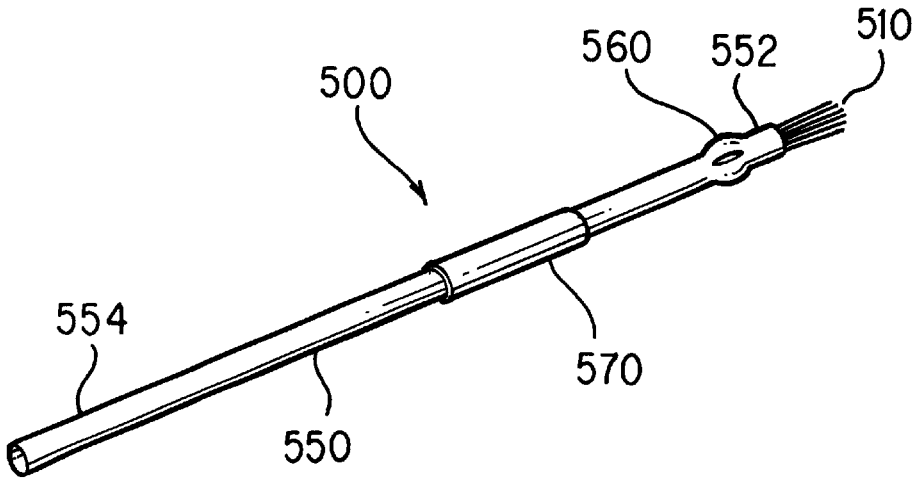
FIG. 3 illustrates the electrode cleaning apparatus of FIG. 2 with an embodiment for a cover disposed in a first position on the cleaning apparatus.

FIG. 3 illustrates electrode cleaning tool 500 with a cover 570 disposed on support member 550. Cover 570 is a hollow cylindrical member and is slidably disposed on support member 550. Cover 570 is slidably disposed on support member 550 such that it may be moved between a first position, as illustrated in FIG. 3, where cover 570 is disposed away from the plurality of tungsten wires 510, and a second position, as illustrated in FIG. 4, where cover 570 receives the plurality of tungsten wires 510 within it. It may be desirable to position cover 570 in its second position when electrode cleaning tool 500 is not being used, where cover 570 receives wires 510 within it, in order to help to prevent a user of the tool from injuring himself/herself by contacting the tungsten wires 510 with their hands and also to prevent damage to the wires 510.

Cover 570 may be moved on support member 550 towards second end 554 of support member 550 such that it may be removed from support member 550. Thus, there is no stopping apparatus provided on support member 550 that prevents cover 570 from being removed off of support member 550 at its second end 554. Conversely, stop 560, which was discussed previously and which is located at first end 552 of support member 550, engages with cover 570 as cover 570 is moved into its second position such that cover 570 is prevented from moving beyond stop 560 at the first end 552 of support member 550. The interaction of stop 560 with cover 570 will be discussed further in connection with FIG. 5. As with support member 550, cover 570 may be manufactured from a variety of materials, including plastics or metals. Cover 570 should be comprised of a rigid-enough material such that when cover 570 is disposed over wires 510, cover 570 can both protect wires 510 from being damaged and prevent a user of tool 500 from being possibly injured.

FIG. 5 is a cross-sectional view of cover 570 in its second position on support member 550, as taken along line 5—5 of FIG. 4, which further illustrates the interaction between cover 570 and stop 560. As can be seen in FIG. 5, extended portions 564 of stop 560 extend a distance beyond the outer diameter of support member 550. Cover 570, as mentioned previously, is a hollow member that has a first inside diameter $ID_1$ at a first end 572 of cover 570 and a second inside diameter $ID_2$ at a second end 574 of cover 570. Inside diameter $ID_1$ is larger than inside diameter $ID_2$. Support member 550 has a crimp diameter CD defined by stop 560. Crimp diameter CD is measured from the outer-most structure of an extended portion 564 on one side of support member 550 to the outer-most structure of an extended portion 564 that is disposed on a second, opposite side of support member 550. Thus, in this embodiment, crimp diameter CD defines the largest diameter along any portion of support member 550. Inside diameter $ID_1$ of cover 570 is larger than crimp diameter CD of support member 550 and crimp diameter CD is larger than inside diameter $ID_2$ of cover 570. Thus, as cover 570 is moved on support member 550 to its second position where cover 570 receives wires 510 within it, first end 572 of cover 570 is able to move over and beyond crimp diameter CD of support member 550. However, since inside diameter $ID_2$ of cover 570 is less than crimp diameter CD of support member 550, the extended portions 564 of stop 560 will engage with the interior wall structure of cover 570 at a location proximate to the second end 574 of cover 570. This engagement of extended portions 564 with cover 570 will prevent cover 570 from moving beyond stop 560. In this manner, cover 570 may be moved to its second position where wires 510 are received within it but yet may not be moved beyond first end 552 of support member 550, thus preventing cover 570 from being removed from support member 550 at its first end 552.

As can also be seen in FIG. 5, and as was also described previously, indentations 562 that are defined by stop 560 engage with wires 510 on an interior side of support member 550 in order to secure wires 510 to support member 550. The structural connection between indentations 562 and wires 510 is sufficient to retain wires 510 within support member 550, however, in order to further secure wires 510 within support member 550, an adhesive could also be utilized within support member 550. The adhesive could be utilized in conjunction with indentations 562 or could be used independently of indentations 562 in order to secure wires 510 within support member 550.

Figure 6:
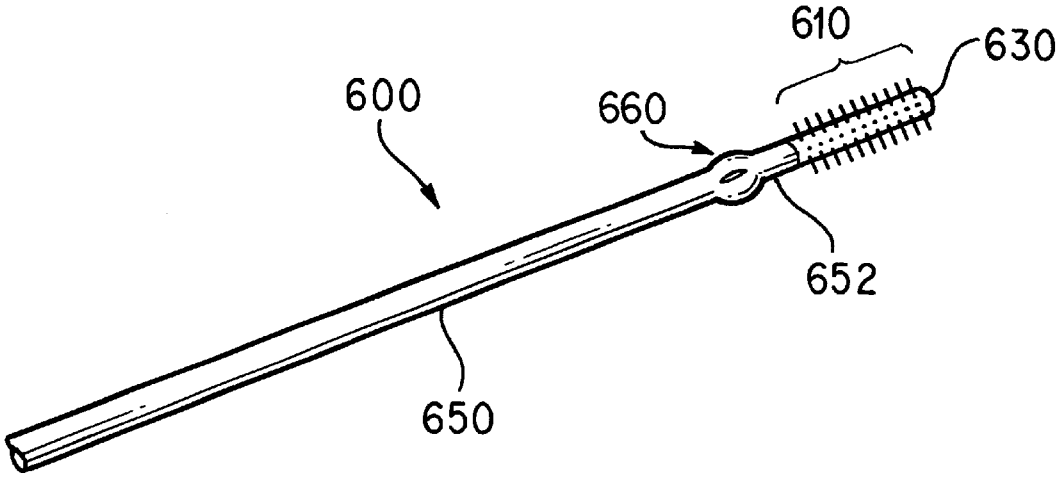
FIG. 6 illustrates an electrode cleaning apparatus in accordance with a second embodiment of the present invention.

Several alternatives on the disclosed embodiments are contemplated. FIG. 6 illustrates a second embodiment for an electrode cleaning tool 600 in accordance with the principles of the present invention. As can be seen in FIG. 6. electrode cleaning tool 600 includes a support member 650 and a stop 660, as were previously described for the embodiment of FIG. 2. Additionally, even though not illustrated, electrode cleaning tool 600 may also include a cover as previously described. Electrode cleaning tool 600 also includes a plurality of tungsten wires 610, however, in this embodiment, the tungsten wires 610 do not extend from first end 652 of support member 650 along the longitudinal axis of support member 650, rather, the wires 610 extend from a cylindrical member 630 in an orientation perpendicular to the longitudinal axis of support member 650. Cylindrical member 630 is attached to first end 652 of support member 650.

Whereas the plurality of wires 610 are illustrated as extending around the entire outer periphery of cylindrical member 630 in FIG. 6, it is also contemplated that the wires 610 could only extend around a portion of cylindrical member 630. For example, wires 610 could extend around the circumference of cylindrical member 630 on a portion of cylindrical member 630 or could extend along the length of cylindrical member 630 on only a portion of the circumference of cylindrical member 630. Thus, the present invention is not limited to any particular orientation for the tungsten wires with respect to either support member 650 or cylindrical member 630. Additionally, it is not required that wires 610 extend from a cylindrical member. Alternatively, wires 610 could extend from first end 652 of support member 650.

Figure 7:
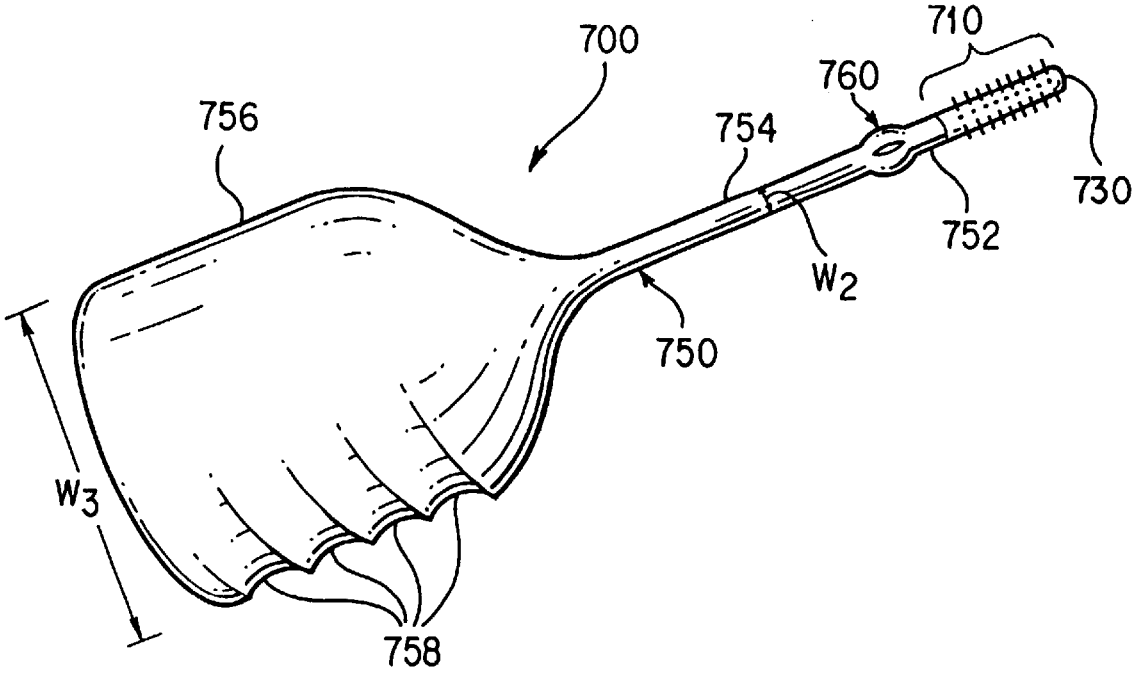
FIG. 7 illustrates an alternative embodiment for a support member of an electrode cleaning apparatus in accordance with the principles of the present invention.

FIG. 7 illustrates another alternative embodiment for an electrode cleaning tool in accordance with the principles of the present invention. As can be seen in FIG. 7, electrode cleaning tool 700 includes a support member 750, a cylindrical member 730 attached to a first end 752 of support member 750, and a plurality of tungsten wires 710 extending from cylindrical member 730, as was described previously when discussing FIG. 6. Support member 750 includes a first portion 754 that is constructed as a thin, elongated member that has a width $W_2$ which is similar to the width $W_1$ that was described when discussing support member 550 of FIG. 2. Support member 750 also includes a second portion 756 which is formed as a structure suitable for accommodating the hand of a user of electrode cleaning tool 700. Second hand gripping portion 756 has a width $W_3$ which is substantially larger than width $W_2$ of first portion 754 and is sized such that it generally has a width that is equal to the width of a user's hand. Second hand grip portion 756 has recesses 758 formed in it that are designed to accommodate the fingers of the user of electrode cleaning tool 700. As can be seen in FIG. 7, there are four recesses 758 defined on a first side of second portion 756 which accommodate the fingers of the user and, although not visible in FIG. 7, there is an additional recess 758 formed on an opposed side of second portion 756 to accommodate the user's thumb.

The embodiment of FIG. 7 for electrode cleaning tool 700 also includes a stop 760 and a cover (not illustrated), the purpose and function of which is as was described previously. Additionally, tool 700 could also utilize the embodiment of FIG. 2 for the orientation of the tungsten wires.

In utilizing the present invention, a user cleans the surface area of the electrodes of an optical fiber splicing machine with the tungsten wires. The user brushes the tungsten wires across the surface of the electrodes and the frictional forces between the tungsten wires and the surface of the electrodes removes a large majority, up to perhaps ninety percent, of the residue from the surface of the electrodes. The equivalent hardness between the tungsten wires and the tungsten electrodes allows for more efficient cleaning of the electrodes when compared to utilizing a glass bristle tool to clean the electrodes. After the user has brushed the tungsten electrodes with the tungsten wires, the user could utilize a lint-free cotton swab, or other similar material, that has been dipped in a solvent, such as methanol, to take the residue off of the electrodes.

Whereas it has been described that the tungsten wires are used to clean tungsten electrodes, the present invention is not limited to only being utilized to clean tungsten electrodes. The present invention has utility for cleaning any of a variety of different types of electrodes. For example, the electrodes could be made from stainless steel or any other hard material. Additionally, the present invention is not only limited to utilizing tungsten wires. The present invention could be utilized by using any other material for the cleaning tool wires that are as hard, or harder, than the material from which the electrodes are made.

In summary, the present invention provides an improved apparatus and method for cleaning electrodes of an optical fiber splicing machine. The present invention provides for removing a much larger quantity of residue from the electrodes than is possible by utilizing a currently known cleaning tool.

The disclosed embodiments are illustrative of the various way in which the present invention may be practiced. Other embodiments can be implemented by those skilled in the art without departing from the spirit and scope of the present invention.

What is claimed is:

1. An apparatus for cleaning electrodes with a fiber optic splicing apparatus comprising:

a support member having a first end;

a plurality of tungsten wire fibers coupled to said support member at said first end;

a cover slidably disposed on said support member such that said cover is movable between a first position wherein said cover is disposed away from said plurality of tungsten fibers and a second position wherein substantially the length of said plurality of tungsten fibers are received within said cover; and a stop at said first end of said support member wherein said stop cooperates with said cover to restrain said cover from sliding beyond said first end of said support member, said stop including a crimped portion of said support member, said crimped portion defining a plurality of indentations in said support member and a plurality of extended portions in said support member, said extended portions extending a distance beyond a diameter of said support member, said crimped portion engages said plurality of tungsten wire fibers to secure said plurality of tungsten wire fibers within said support member.

2. The apparatus of claim 1 wherein said support member comprises a thin, elongated structure.

3. The apparatus of claim 2 wherein said support member is a hollow structure.

4. A apparatus of claim 1 wherein said support member is comprised of a plastic material.

5. The apparatus of claim 1 wherein said support member is comprised of a metal material.

6. The apparatus of claim 1 wherein said cover has a first internal diameter at a first end of said cover and a second internal diameter at a second end of said cover, said second internal diameter smaller than said first internal diameter and said second internal diameter smaller than a diameter of said crimped portion of said support member, said second end of said cover cooperating with said crimped portion of said support member to prevent said second end of said cover from sliding beyond said crimped portion of said support member.

7. The apparatus of claim 1 wherein said support member includes a first thin, elongated portion and a second hand grip portion, said second portion having a width larger than a width of said first portion and said second portion defining a plurality of recesses therein.

8. An apparatus for cleaning electrodes of a fiber optic splicing apparatus comprising:

a support member having a first end;

a plurality of tungsten wire fibers coupled to said support member at said first end;

a cover slidably disposed on said support member such that said cover is movable between a first position wherein said cover is disposed away from said plurality of tungsten fibers and a second position wherein substantially the length of said plurality of tungsten fibers are received within said cover; and a cylindrical member, said cylindrical member attached to said support member at said first end of said support member and said plurality of tungsten wire fibers extending perpendicularly from said cylindrical member, said plurality of tungsten wire fibers extend around the circumference of said cylindrical member.

9. An apparatus for cleaning electrodes of a fiber optic splicing apparatus comprising:

a plurality of tungsten wire fibers;

a support member, said plurality of tungsten wires fibers coupled to said support member at a first end of said support member;

a cover slidably disposed on said support member such that said cover is movable between a first position wherein said cover is disposed away from said plurality of tungsten fibers and a second position wherein substantially the length of said plurality of tungsten fibers are received within said cover; and a stop at said first end of said support member wherein said stop cooperates with said cover to restrain said cover from sliding beyond said first end of said support member, said stop having a crimped portion of said support member, said crimped portion defining a plurality of indentations in said support member and a plurality of extended portions in said support member, said extended portions extending a distance beyond a diameter of said support member.

10. The apparatus of claim 9 wherein said cover has a first internal diameter at a first end of said cover and a second internal diameter at a second end of said cover, said second internal diameter smaller than said first internal diameter and said second internal diameter smaller than a diameter of said crimped portion of said support member, said second end of said cover cooperating with said crimped portion of said support member to prevent said second end of said cover from sliding beyond said crimped portion of said support member.

11. The apparatus of claim 9 wherein said crimped portion engages said plurality of tungsten wire fibers to secure said plurality of tungsten wire fibers within said support member.

* * * * *